US009234490B2

(12) United States Patent
Kuhlbach et al.

(10) Patent No.: US 9,234,490 B2
(45) Date of Patent: Jan. 12, 2016

(54) MULTI-CYLINDER INTERNAL COMBUSTION ENGINE AND METHOD FOR OPERATING SUCH A MULTI-CYLINDER INTERNAL COMBUSTION ENGINE

(71) Applicant: Ford Global Technologies, LLC, Dearborn, MI (US)

(72) Inventors: Kai Sebastian Kuhlbach, Bergisch Gladbach (DE); Guenter Bartsch, Gummersbach (DE); Albert Breuer, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 474 days.

(21) Appl. No.: 13/733,048

(22) Filed: Jan. 2, 2013

(65) Prior Publication Data

US 2013/0167803 A1 Jul. 4, 2013

(30) Foreign Application Priority Data

Jan. 2, 2012 (DE) ..... 10 2012 200 014

(51) Int. Cl.

*F02B 75/02* (2006.01)
*F02P 9/00* (2006.01)
*F01N 13/10* (2010.01)

(52) U.S. Cl.

CPC ..... *F02P 9/00* (2013.01); *F01N 13/105* (2013.01)

(58) Field of Classification Search

CPC . F02B 33/00; F01N 2410/00; F01N 2390/00; F01N 2470/00; F01N 2470/08; F01N 2470/14; F01N 2470/16; F01N 2470/30

USPC ..... 123/41.82 R, 193.5, 363, 65 PE, 65 A, 123/65 EM, 65 P; 60/323, 324

See application file for complete search history.

(56) References Cited

U.S. PATENT DOCUMENTS

| | | | | |
|---|---|---|---|---|
| 2008/0308050 | A1* | 12/2008 | Kuhlbach et al. | 123/41.82 R |
| 2010/0269878 | A1* | 10/2010 | Kuhlbach | 136/201 |
| 2012/0240574 | A1* | 9/2012 | Friedfeldt et al. | 60/602 |
| 2012/0312002 | A1* | 12/2012 | Kuhlbach et al. | 60/323 |
| 2013/0276752 | A1* | 10/2013 | Breuer et al. | 123/395 |
| 2013/0276754 | A1* | 10/2013 | Breuer et al. | 123/434 |
| 2013/0291811 | A1* | 11/2013 | Kuhlbach | 123/41.72 |
| 2014/0053806 | A1* | 2/2014 | Weber et al. | 123/363 |

FOREIGN PATENT DOCUMENTS

| | | | |
|---|---|---|---|
| DE | 2021600 | A1 | 11/1971 |
| WO | 2007008488 | A2 | 1/2007 |
| WO | 2008099758 | A1 | 8/2008 |

* cited by examiner

*Primary Examiner* — John Kwon

(74) *Attorney, Agent, or Firm* — Greg Brown; Alleman Hall McCoy Russell & Tuttle LLP

(57) ABSTRACT

A linearly aligned four-cylinder internal combustion engine system operated in a 1-3-4-2 sequence, comprising a cylinder head connected with a cylinder block wherein each cylinder has at least one exhaust port to discharge exhaust gasses via an exhaust gas discharge system, for which an exhaust gas pipe is connected at each exhaust port; wherein the exhaust gas pipes of the cylinders that merge in stages into a common exhaust gas pipe and the exhaust gas discharge system emerges outside of the cylinder head. Thus exhaust gas from consecutive ignitions in adjacent cylinders is separated for a distance throughout the engine head to reduce mutual influencing in adjacent cylinders with consecutive ignitions.

19 Claims, 3 Drawing Sheets

MULTI-CYLINDER INTERNAL COMBUSTION ENGINE AND METHOD FOR OPERATING SUCH A MULTI-CYLINDER INTERNAL COMBUSTION ENGINE

CROSS REFERENCE TO RELATED APPLICATIONS

The present application claims priority to German Application 102012200014.3, filed on Jan. 2, 2012, the entire contents of which are hereby incorporated by reference for all purposes.

BACKGROUND AND SUMMARY

The multi-cylinder internal combustion engines of motor vehicles often include at least one cylinder head connected to the mounting face of a cylinder block and four cylinders arranged in line along the longitudinal axis of the cylinder head, wherein each cylinder is equipped with ignition devices to initiate external ignition. Each cylinder generally contains at least one exhaust port to discharge the exhaust gasses from the cylinder via the exhaust gas discharge system, wherein each exhaust gas pipe is connected at each exhaust port. In the context of the following specification the term "engine," in particular, comprises petrol engines equipped with external ignition. Engines have at least one cylinder head and one cylinder block which are connected together at their mounting faces to form the individual cylinders referred to as combustion chambers.

The cylinder head frequently serves to hold the valve actuating mechanism called the valve gear to control the charge change. In charge change, combustion gasses are expelled via the exhaust ports and a fresh mixture or fresh air is drawn in via the inlet ports, filling the combustion chamber. Reciprocating valves are often used as charge change control elements during operation of the engine to open and close the inlet and exhaust ports, wherein the aim is rapid opening of a flow cross-section large enough to keep choke losses low and maximize the fill of the cylinders. Therefore, cylinders are frequently fitted with two or more inlet or exhaust ports. Downstream of the manifold the exhaust gasses may then be sent to a turbine of the exhaust turbocharger and/or to one or more exhaust post-treatment systems. Power released by combustion is adjusted by changing the fill of the combustion chamber by adjusting the pressure in the aspirated air and varying the aspirated air mass. Lower loads rely upon a higher choking, so charge change losses are increased the low load region.

One approach for dechoking the working process of the petrol engine lies in the use of a variable valve gear with which the stroke of the valves and/or the control times can be varied to a greater or lesser extent. Varying the control times of the valves is achieved by use of a camshaft adjustment device with which the camshaft can be twisted through a certain angle in relation to the crankshaft allowing control times to be advanced or retarded without varying the opening duration of the valves. In this method of variable valve control, valve overlap depends on the crank angle range in which the exhaust is not yet closed while the inlet remains open. During valve overlap at high loads "flushing losses" can occur, wherein part of the aspirated fresh air flows through the cylinder without participating in the subsequent combustion. A variable valve control allows decreasing the valve overlap in response to increased rotation speed. For engines charged by means of exhaust turbocharging, at low rotation speeds a large valve overlap is suitable for raising the maximum torque and improving the unstable operating behavior. A pressure fall present at low rotation speeds between the inlet side and exhaust side supports an effective flushing of the cylinders with fresh air and ensures greater cylinder filling and hence higher power. A large valve overlap, possibly from late closure of the at least one exhaust valve, is also suitable for reducing the pumping and the resulting charge change losses.

Charge change has proved problematic for the exhaust pipes of the cylinders. Degradation can occur from the respective exhaust port through to the collection point in the exhaust gas discharge system at which the exhaust pipes merge into a common exhaust pipe and the hot exhaust gas from the cylinders is collected, this is compounded by the increasingly shorter exhaust pipe designs in modern engines. Increasingly often, the exhaust gas discharge system is integrated, at least partly, in the cylinder head in order to participate in the cooling provided in the cylinder head and reduce the need for expensive thermally heavy duty materials. Short exhaust pipes can lead to a mutual disadvantage of the cylinders of the engine on the effect on charge change, in particular, the effect achieved by residual gas flushing may be decreased. Thus in an in-line engine operated in a combustion sequence, the charge change of a cylinder can have a disadvantageous effect on the cylinder immediately preceding it in the ignition sequence due to different mechanisms competing to evacuate exhaust gas.

For example, exhaust gas emerging from the one cylinder entering another cylinder before its exhaust valves close resulting in two different mechanisms competing to evacuate combustion gasses from the fourth cylinder. Various approaches may be used to combat the problem arising from the short exhaust pipes, these approaches include shortening the opening duration of the exhaust valves by opening a valve later or closing a valve sooner. Use of large valve overlap is often heightened at low engine speeds by opening the valve later while maintaining closing time, this measure maintains engine torque at low engine rotation speeds; however, power disadvantages arise from shortened valve duration at high engine rotation speeds from the reduction in pumping in the low load range to reduce fuel consumption.

The inventors herein recognized this problem inherent in shortened exhaust pipes and recognized that some of the issues addressed above by providing some degree of isolation of the exhaust pipes of cylinders adjacent in the ignition sequence. Further, this method would alleviate the problems of mutual influence of adjacent cylinders on charge change while maintaining the benefits of a large valve overlap or long exhaust opening duration o minimize the power disadvantages arising with at high rotation speeds and/or with regard to the reduction of pumping in low load operation.

DETAILED DESCRIPTION

Figure 1:
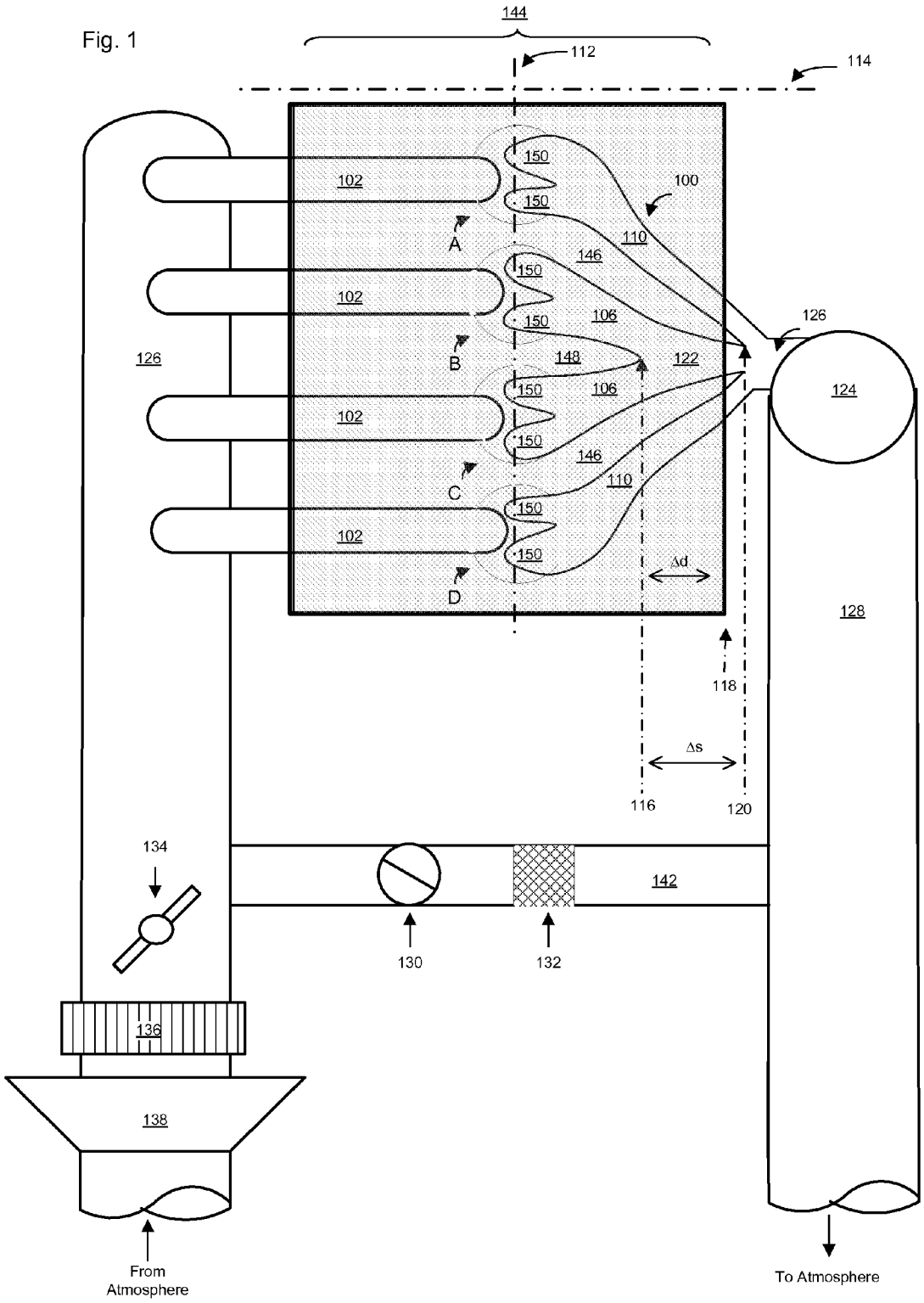
FIG. 1 is a sample embodiment of an exhaust discharge system within a cylinder head.

In an engine, the cylinder head frequently serves to hold the valve gear. To control the charge change, an engine often utilizes control elements and actuation devices to activate the control elements. In the context of the charge change, combustion gasses are expelled via the exhaust ports and a fresh mixture or fresh air is drawn in via the inlet ports, filling the combustion chamber. To control charge change reciprocating valves are used as control elements, almost exclusively in four stroke engines. The reciprocating valves execute an oscillating reciprocal motion during operation of the engine and thus open and close the inlet and exhaust ports. A valve gear is a valve actuating mechanism able to move the valves. A valve actuating device frequently comprises a camshaft on which multiple cams are arranged.

The function of the valve gear is to open and close the inlet and exhaust ports of the cylinders at the correct time, wherein the aim is rapid opening of a flow cross-section large enough to keep choke losses low in the gas inflow and outflow to maximize the possible fill of the cylinders with fresh mixture and the corresponding discharge of exhaust gasses. Therefore, cylinders are frequently fitted with two or more inlet or exhaust ports.

The four cylinders arranged in line of the at least one cylinder head of the engine which is the subject of the present disclosure have at least one exhaust port to discharge the exhaust gasses via the exhaust gas discharge system. The exhaust pipes of the cylinders are merged into a common exhaust pipe in stages, forming an exhaust gas discharge system. Downstream of the manifold the exhaust gasses are then where applicable sent to a turbine of the exhaust turbocharger and/or to one or more exhaust post-treatment systems.

Power released by combustion is adjusted by changing the fill of the combustion chamber, the resulting quantity regulation can result in higher fuel consumption and lower efficiency in the petrol engine than in its diesel counterpart. The load control usually takes place by adjusting the pressure in the aspirated air and varying the aspirated air mass via the throttle valve in the intake track. Lower loads utilize higher choking, so charge change losses are increased the low load region.

In a four-cylinder in-line engine, the cylinders of which may be operated by a control system with instructions to ignite in the sequence 1-3-4-2, the charge change of a cylinder may have a disadvantageous effect on the cylinder preceding it in the ignition sequence. For example, the exhaust gas emerging from the fourth cylinder may enter the third cylinder before its exhaust valves close resulting in two different mechanisms competing to evacuate combustion gasses from the fourth cylinder. If an exhaust valve, for instance, opens at the start of charge change, the high pressure level predominating in the cylinder towards the end of combustion creates a high pressure difference between the combustion chamber and the exhaust gas system resulting in combustion gasses flowing at high speed through the exhaust port into the exhaust pipe. Presence of exhaust gasses from the fourth cylinder in the third cylinder along with the heightened exhaust lead pulse can cause degradation in the exhaust pipe system. Ignition of the cylinders in sequence 1-3-4-2 is advantageous because the exhaust gas discharge system according to the specification has been optimized with regard to this ignition sequence, whereby the desired positive effect is achieved in particular in connection with said ignition sequence.

This pressure-driven flow process is stronger the higher the torque emitted, and is accompanied by a high pressure peak—also called an exhaust lead pulse—which propagates along the exhaust pipe. Further along the course of the charge change, the pressures in the cylinder and in the exhaust pipe largely balance out so that the combustion gasses are now expelled as a result of the piston movement. However, the initial presence of exhaust gasses from the fourth cylinder in the third cylinder along with the heightened exhaust lead pulse can cause degradation in the exhaust pipe system.

This problem can be reduced by employing a cylinder head in which the exhaust gas pipes of the cylinders merge in stages into a common exhaust gas pipe, and the exhaust gas discharge system emerges at outside of the cylinder head as shown in FIG. 1. In this disclosure the longitudinal axis is the axis of alignment of the cylinders (114 on FIG. 1) and the latitudinal axis is the axis perpendicular to the longitudinal axis parallel to the base of the cylinder head (144 in FIG. 1). The cylinder head and exhaust gas discharge system is further detailed in FIG. 2, here the exhaust gas discharge system is shown independently. In FIG. 3 the cross section of the exhaust gas discharge system is shown at the edge of the cylinder head. It can be advantageous to integrate the exhaust gas discharge system largely into the one or more cylinder head(s) thus merging the exhaust pipes as extensively as possible in the cylinder head itself as allowing a more compact construction and denser packaging and thus cost and weight benefits. These benefits may further aid turbochargers and exhaust gas recirculation systems.

In the embodiment in FIG. 1, air entering the engine may be compressed by a turbocharger compressor 138 before entering an intake system. This air may then be cooled by air cooler 136 and at throttle valve 134 some air may be allowed to pass into the intake manifold through intake pipes 102 for charge and combustion within the ignition chambers A, B, C, D. After combustion, the exhaust may escape through the exhaust gas discharge system 100 and exit through exhaust pipe 128 at which point some exhaust may be recirculated into the intake manifold or into the atmosphere.

Embodiments of the engine may have at least one charging device. A charging device can, for example, be an exhaust turbocharger and/or a compressor. In particular, embodiments of the engine are advantageous with at least one exhaust turbocharger comprising a turbine 124, wherein the turbine is arranged in the exhaust gas discharge system and comprises an inlet region to supply the exhaust gasses.

Further embodiments of a turbocharger may comprise a compressor and a turbine which are arranged on the same shaft (not shown). The hot exhaust gas flow may be supplied to the turbine and expand, emitting energy to the turbine and setting the shaft in rotation. The energy emitted by the exhaust gas flow at the turbine and finally at the shaft may be used to drive the compressor which may also be arranged on the shaft. Cylinder charging occurs upon the compressor delivering and compressing the charge air supplied to it. If applicable, charge air cooling may be provided with which the compressed combustion air is cooled before entering the cylinders by charge air cooler 136. This charging serves primarily to increase the performance of the engine. By compressing the air for the combustion process, a greater air mass can be supplied to each cylinder per working stroke. As a result, the fuel mass and hence the average pressure can be increased thus increasing the power of an engine without changing capacity and inducing more favorable performance measurements. Therefore, the load collective can be shifted towards higher loads at which the specific fuel consumption is lower for the same vehicle peripheral conditions. Embodiments may also utilize an exhaust gas recirculation system. Further embodiments may not have a turbocharger nor an exhaust gas recirculation system.

The exhaust gas discharge system 100 is connected at a mounting face with a cylinder block (not shown) comprising four cylinders arranged in line along the longitudinal axis 112 of the cylinder head 144. Each cylinder has at least one exhaust port 150 to discharge the exhaust gasses from the cylinder via the exhaust gas discharge system, for which an exhaust pipe 110 and 106 is connected at each exhaust port.

Embodiments of the engine may be advantageous in which each cylinder has at least two exhaust ports to discharge the exhaust gasses from the cylinder. During the charge change a rapid release of as large a flow cross-section as possible is desired, in order to keep the choke losses on the out flowing exhaust gasses as low as possible and guarantee effective discharge of the exhaust gasses. It is therefore advantageous to equip the cylinders with two or more exhaust ports.

In the present case each cylinder (A, B, C, D) has two emerging exhaust ports 150 that merge into 4 separate exhaust pipes: innermost exhaust pipes 106 emerging from cylinder B and C, respectively, and outermost exhaust pipe 110 emerging from cylinder A and D, respectively, that are themselves merged in stages. The exhaust pipes for each respective cylinder exhaust port emerge inside the cylinder head 144, other embodiments may have a single exhaust pipe per cylinder or a multiplicity of exhaust pipes per cylinder. The innermost exhaust pipes 106 of the two internal cylinders (B and C) are merged at a first junction 116 into a part exhaust pipe 122 within the cylinder head 144. The part exhaust pipe 122 is then merged with the exhaust pipes of the two outermost cylinders (A and D) into a single common exhaust pipe 126 at a collection point 120. In FIG. 1, this occurs inside the cylinder head 144. With this manner of merging, two cylinders adjacent in the ignition sequence are kept separated from each other on the exhaust side for longer, such that the length of the exhaust pipes connecting these cylinders (and hence the relevant exhaust gas travel lengths) are enlarged. The exhaust gas discharge system alleviates the mutual influencing of the cylinders on a charge change, which results from shorter exhaust pipes. Thus, three separate exhaust pipes emerge from the cylinder head 144 before converging to a single exhaust pipe 126. The outermost exhaust pipes 110 are therefore isolated from the innermost exhaust pipes 106 until they are outside of the cylinder head. This method is can also be used with different alignment or ignition sequence wherein the results can be achieved by first merging the exhaust pipes with ignition spacing of 360° crank angle (CA).

In either embodiment, shortening of opening duration to suppress the mutual influencing of the cylinders on charge change can be reduced as the merging of the exhaust pipes from cylinders adjacent in the ignition sequence minimize exhaust gasses from one cylinder enter the cylinder previously ignited. Further, the benefits of a large valve overlap or long exhaust opening duration can be utilized, without two cylinders adjacent in the ignition sequence hindering each other on charge change.

Accordingly, one outermost exhaust pipe 110 is separated from the two innermost exhaust pipes 106 by an outer wall segment 146. The outermost exhaust pipe 110 is separated from the two innermost exhaust pipes 106 by an outer wall segment 146. The two innermost exhaust pipes 106 are separated for a distance within the cylinder head and inner wall segment 148 that ends at a first junction 116 to form the part exhaust pipe 122.

An embodiment may also be arranged to accommodate engines that have two cylinder heads if, for example, the cylinders are divided into two cylinder banks The merging of the exhaust pipes in the method described herein similarly leads to an improvement in charge change and an improvement in torque provision. This embodiment is beneficial because the inner wall segment 148 ending within the cylinder head 144 is at s distance of $\Delta d>0$ from the cylinder head outer wall 118.

Engine embodiments may also utilize an inner wall segment protruding into the exhaust gas discharge system that have a latitudinal distance from the outside of the cylinder head as shown in FIG. 1 as $\Delta d$. This arrangement may be most advantageous if $\Delta d \geq 15$ mm. In other embodiments of the engine are advantageous in which the inner wall segment has a distance from the outer wall of the cylinder head of $\Delta d \geq 20$ mm, preferably a distance of $\Delta d \geq 25$ mm.

Increasing the distance $\Delta d$ and decreasing the length of the inner wall segment may allow for a more compact cylinder head design. A shorter inner wall segment allows a steeper merging of the two outer most exhaust pipes within the part exhaust pipe and thus the collection point to occur a shorter latitudinal distance from the cylinders.

In some embodiments of the engine, it may be advantageous for the outer wall segments to extend further than the inner wall segment in the latitudinal direction of the outside of the cylinder head by a distance $\Delta s$, wherein $\Delta s \geq 5$ mm. Particular embodiments may utilize a value of $\Delta s \geq 10$ mm. In particular embodiments of the engine are advantageous in which $\Delta s \geq 10$ mm.

Computer-supported simulations show that in individual cases a satisfactory torque characteristic can be achieved even when the outer wall segment extends 5 mm or more beyond the inner wall segment in the direction of the outside of the at least one cylinder head, wherein the distance $\Delta s$ is measured perpendicular to the longitudinal axis of the at least one cylinder head and as a reference point, the point on the wall segment is taken which protrudes furthest into the exhaust gas discharge system in the direction of the outside.

A greater length of protrusion of the outer wall segments beyond the inner wall segment will have a more pronounced travel distance separation of the exhaust pipes and a more perceptible resulting effect. Namely, cylinders ignited successively on charge change will exert less mutual influence and hindrance.

Therefore, embodiments of the engine may be advantageous in which the exhaust pipes of the cylinder merge into a common exhaust pipe inside the cylinder head to form an integrated exhaust manifold (not shown) and will retain all of the advantages which come from an exhaust gas discharge system fully integrated in the cylinder head.

Figure 2:
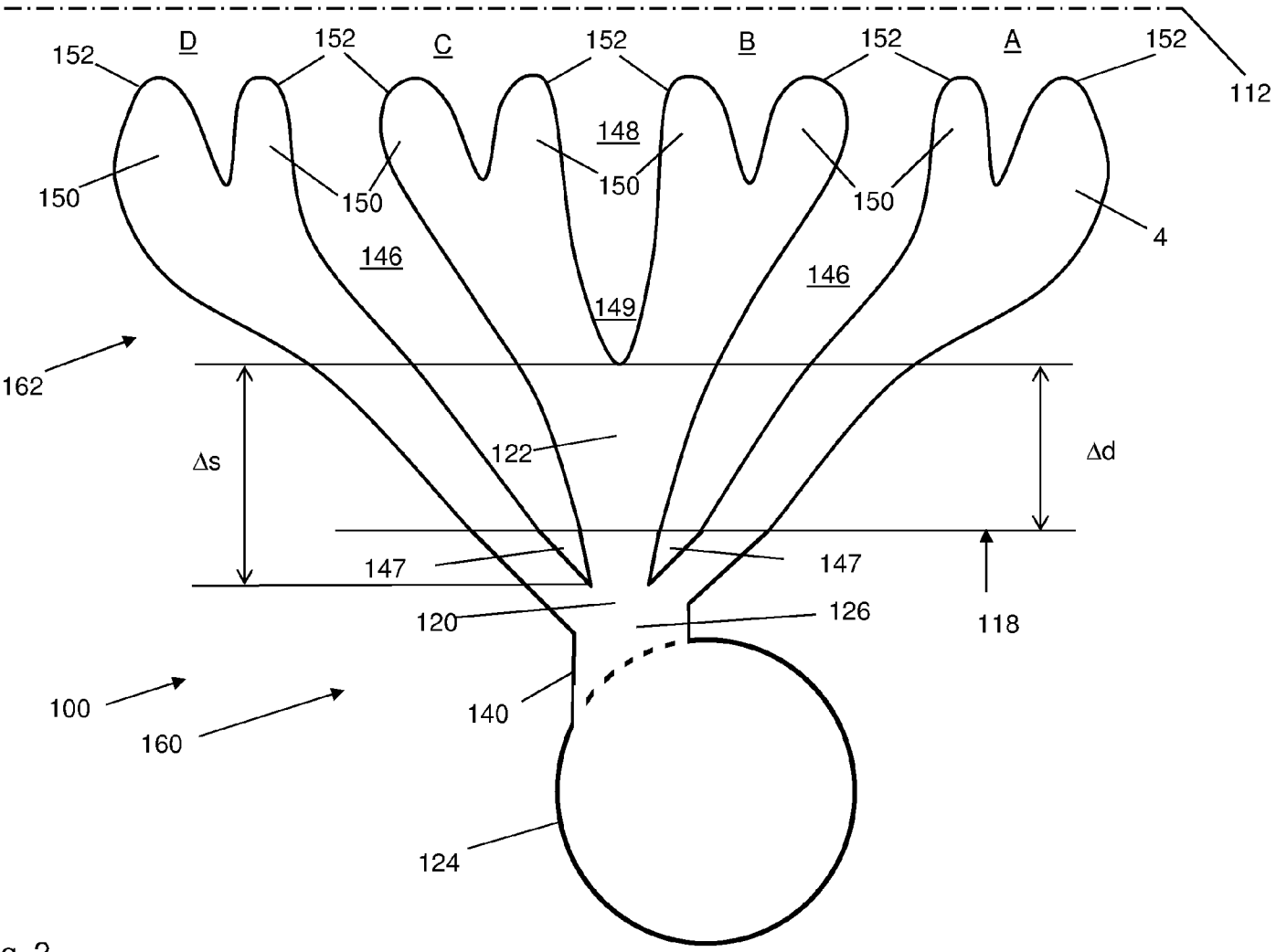
FIG. 2 is a diagram of a sample embodiment of an exhaust discharge system.
Figure 3:
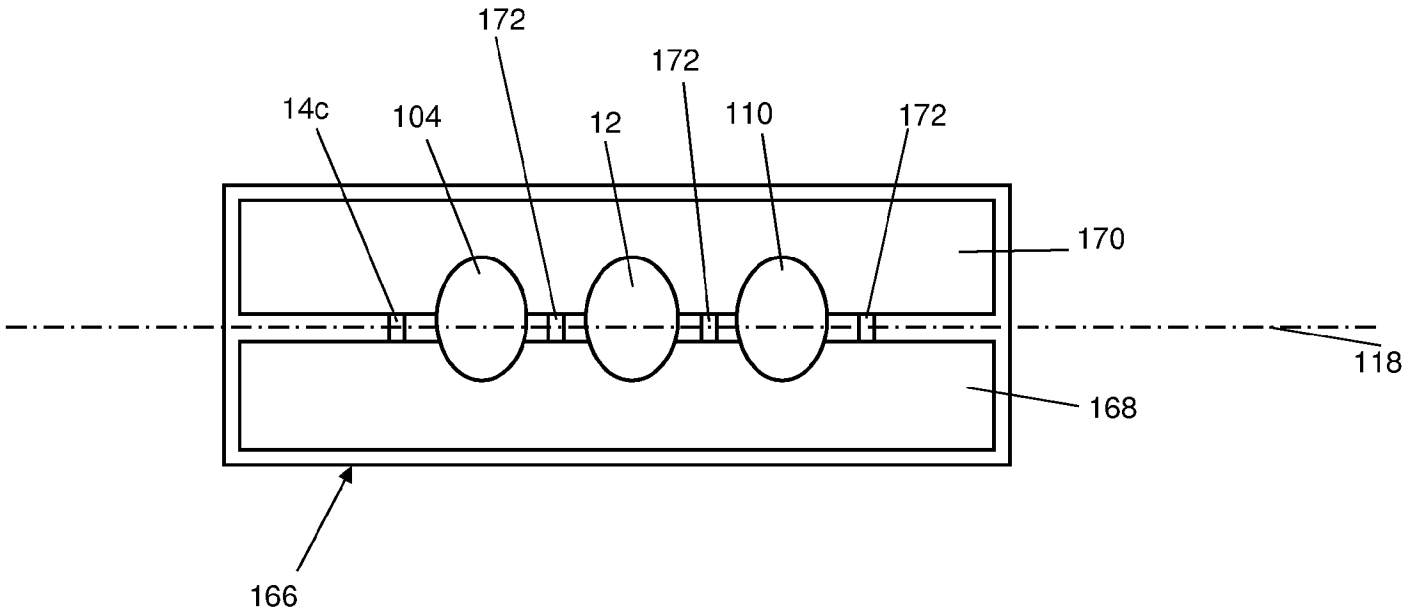
FIG. 3 is a cross section of the embodiment of FIG. 2 at the longitudinal edge of the cylinder head.

Nonetheless, embodiments of the engine can be advantageous in which the part exhaust pipe of the two innermost cylinders and the exhaust pipes of the two outermost cylinders merge into a common exhaust pipe outside the cylinder head, such as FIG. 1 also elaborated in FIG. 2. FIG. 2 shows a portion of the exhaust gas discharge system 100 of a first embodiment of the engine in top view. The drawing plane runs parallel to the mounting face (not shown). The outer wall segments which protrude into the exhaust gas discharge system extend beyond the outside of the cylinder head so that $\Delta s>\Delta d$. The exhaust gas flows are separated from each other by the outer wall segments 146 until they leave the cylinder head 144, so that the exhaust gas discharge system emerges from the cylinder head 144 in the form of three outlet openings. The three exhaust pipes are merged into a common exhaust pipe 126 downstream of the cylinder head 144 and hence outside the cylinder head.

Further, with a common exhaust pipe 126 formed outside the cylinder head 144, embodiments of the engine can be advantageous in which the outer wall segments 146 which protrude into the exhaust gas discharge system extend beyond the outside of the cylinder head 144. According to this embodiment the exhaust flows of the two outermost and part exhaust pipe 122, and 110 are separated from each other by the outer wall segments 146 even after leaving the cylinder head. In this embodiment of the engine, the exhaust gas discharge system also emerges from the cylinder head in the form of three outlet openings (FIG. 3). In other embodiments (not shown) the outer wall segments which protrude into the exhaust gas discharge system may extend up to the outside of the cylinder head wherein $\Delta s = \Delta d$.

The common feature of the two embodiments described above is that the exhaust gas discharge system is designed modular and comprises a manifold segment integrated in the cylinder head and an external manifold or manifold segment. The external manifold segment can also be formed by a component arranged in the exhaust gas discharge system, for example the inlet housing of a turbine or an external manifold.

As in FIG. 1, the cylinder head of FIG. 2 has four cylinders (A, B, C, D) that are arranged along the longitudinal axis 112 of the cylinder head. The cylinder head, therefore, has two outermost cylinders (A and D) and two innermost cylinders (B and C). Each cylinder has two exhaust ports 150 to which are connected the exhaust pipes 106 and 110 of the exhaust gas discharge system to discharge the exhaust gasses. The exhaust pipes 106 and 110 of the cylinders (A, B, C, D) merge in stages into a common exhaust pipe 126, wherein first the innermost exhaust pipes 106 of the two innermost cylinders (B and C) are merged into a part exhaust pipe 122 and this part exhaust pipe 122 is merged with the outermost exhaust pipes 110 of the two outermost cylinders (A and D) into a common exhaust pipe 126.

For this, the two outer wall segments 146 which each, in portions, separate from each other the two outermost exhaust pipes 110 of outermost cylinders (A and D) and the two innermost exhaust pipes 106 of the adjacent innermost cylinder (B and C) and protrude into the exhaust gas discharge system 100, extend further in the direction of the outside 108 of the cylinder head than the inner wall segment 146 which, in portions, separates from each other the innermost exhaust pipes 106 of the two innermost cylinders (B and C) and protrudes into the exhaust gas discharge system.

In this embodiment, the innermost exhaust pipes 106 the two innermost cylinders (B and C) merge within the cylinder head into a part exhaust pipe 122, wherein the inner wall segment 148 protruding into the exhaust gas discharge system has a latitudinal distance $\Delta d$ from the cylinder head outer wall 118. The outer wall segments 146 which protrude into the exhaust gas discharge system 100, however, extend beyond the cylinder head outer wall 118 of the cylinder head, so that the part exhaust pipe 122 of the two innermost cylinders (B and C) and the outermost exhaust pipes 110 of the two outermost cylinders (A and D) merge into a common exhaust pipe 126 outside the cylinder head to form collection point 120.

In the embodiment shown in FIG. 2, the exhaust gas discharge system 100 emerges from the cylinder head in the form of three outlet openings (FIG. 3). The exhaust gas flows of the outermost exhaust pipes 110 and part exhaust pipe 122, even after leaving the cylinder head, are separated from each other by the outer wall segments 146. Thus the outer wall segments 146 are formed modular, wherein in each case the cylinder head 144 forms one part segment and the inlet housing 140 of a turbine 124 arranged in the common exhaust pipe 126 forms a further part segment 147.

To this extent the exhaust gas discharge system 100 is partly integrated in the cylinder head, wherein a manifold segment 162 lying inside the cylinder head is supplemented by a manifold segment 160 lying outside the cylinder head 144, including an external manifold segment 160.

With regard embodiments such as those in FIG. 1 and FIG. 2 wherein the merging of the exhaust pipes occurs outside the cylinder head, the outlet of the exhaust gas discharge system is in the form of three outlet openings, as depicted in FIG. 3. Embodiments of the engine are advantageous in which the part exhaust pipe of the two innermost cylinders and the exhaust pipes of the two outermost cylinders (A and D), on outlet from the cylinder head into the outside, form pipe cross-sections which lie on a line congruent with cylinder head outer wall 118, such that the line cross-sections have equal distances from the mounting face.

FIG. 3 shows the outlet of the exhaust gas discharge system 100 from the cylinder head in the embodiment shown in FIG. 1. The explanations are given merely in addition to those of FIG. 1 and FIG. 2, otherwise reference is made to FIG. 1 and the associated description. The same reference numerals are used for the same components. FIG. 2 is a projection in which the components are shown from several planes.

The center part exhaust pipe 122 of the two innermost cylinders and the laterally adjacent two outermost exhaust pipes 106 and 110 cylinders, on outlet from the cylinder head into the outside, form line cross-sections which lie on a line and have an equal distance from the mounting face 166.

The cylinder head may be equipped with a coolant jacket for liquid cooling and may comprise a lower coolant jacket 168 arranged between the exhaust pipes and the mounting face 166 of the cylinder head, and an upper coolant jacket 170 which may be arranged on the side of the exhaust pipes lying opposite the lower coolant jacket 168. Spaced between the exhaust pipes may be connecting channels 172 that are provided between the lower coolant jacket 168 and the upper coolant jacket 170 which serve for the passage of coolant.

The line route described above allows the compact construction of the cylinder head, in particular the formation of a cylinder head of low height, wherein the height of the head is measured perpendicular to the mounting face. This will lead to reduced head volume and consequently, reduced weight and cost.

With outer wall segments extending beyond the outside of the cylinder head, the outer wall segments can be formed of one piece with the at least one cylinder head, wherein the wall segments in not mounted state of the engine protrude from the cylinder head and project outwards. Alternately, the outer wall segments can also be constructed modular. Embodiments may also have the outer wall segments constructed modular in which the cylinder head forms one part segment and an external manifold or manifold segment forms a further part segment.

Embodiments of the engine may be further advantageous if the outer wall segments are constructed modular and in each case the cylinder head forms one part segment and the inlet region of a turbine forms a further part segment.

The invention claimed is:

1. An internal combustion engine system, comprising:

a cylinder head connected at a mounting face with a cylinder block;

four cylinders arranged in line along a longitudinal axis of the cylinder head, wherein each cylinder has at least one exhaust port to discharge exhaust gases via an exhaust gas discharge system, for which an exhaust gas pipe is connected at each exhaust port;

wherein the exhaust gas pipes of the cylinders merge in stages into a common exhaust gas pipe;

wherein the exhaust gas discharge system emerges outside of the cylinder head; and a control system with instructions to initiate external ignition of the cylinders in the sequence 1-3-4-2, wherein the cylinders starting with an outermost cylinder are counted and numbered along the longitudinal axis of the cylinder head, wherein the exhaust pipes of the cylinders comprise two innermost exhaust pipes that merge at a first junction to form a part exhaust pipe that merges with two outermost exhaust pipes at a collection point, wherein:

the outermost exhaust pipes are separated from the part exhaust pipe by an outer wall segment;

the two innermost exhaust pipes are separated from each other by an inner wall segment;

the first junction occurs within the cylinder head; and the collection point occurs further from the cylinders in the latitudinal direction than the first junction.

2. The system of claim 1, wherein the innermost exhaust pipes merge within the cylinder head into the part exhaust pipe.

3. The system of claim 1, wherein the inner wall segment protruding into the exhaust gas discharge system has a latitudinal distance from the outside of the cylinder head greater than 0.

4. The system of claim 3, wherein the inner wall segment has a latitudinal distance greater than 15 mm.

5. The system of claim 1, wherein the outer wall segments extend further than the inner wall segment in a latitudinal direction outside the cylinder head by a distance greater than 5 mm.

6. The system of claim 1, wherein the two innermost and two outer most exhaust pipes merge into the common exhaust pipe inside the cylinder head, forming an integrated exhaust gas discharge system.

7. The system of claim 1, wherein the part exhaust pipe from the two innermost cylinders and the exhaust pipes from the two outermost cylinders merge into the single common exhaust pipe outside the cylinder head.

8. The system of claim 7, wherein the outer wall segments which protrude into the exhaust gas discharge system extend up to the cylinder head outer wall.

9. The system of claim 7, wherein the outer wall segments which protrude into the exhaust gas discharge system extend beyond the cylinder head outer wall in the latitudinal direction.

10. The system of claim 1, wherein the part exhaust pipe of the two innermost cylinders and the exhaust pipes of the outermost cylinders, on outlet from the cylinder head into the outside, form pipe cross-sections which lie on a line such that line cross-sections have equal distances from the mounting face.

11. The system of claim 1, wherein the outer wall segments are constructed modularly, wherein in each case, the cylinder head forms one part segment and an external manifold segment forms a further part segment.

12. The system of claim 1, wherein the outer wall segments are constructed modularly, wherein, in each case, the cylinder head forms one part segment and an inlet housing of a turbine forms a further part segment.

13. The system of claim 1, further comprising at least one charging device.

14. A method, comprising:

igniting cylinders of a four cylinder combustion engine in a sequence 1-3-4-2; and discharging exhaust gas from the cylinders via two innermost and two outermost exhaust pipes, the innermost exhaust pipes merging at a first junction within a cylinder head to form a part exhaust pipe, the part exhaust pipe merging with the outermost exhaust pipes into a common pipe downstream of the first junction.

15. The method of claim 14, wherein the part exhaust pipe merges with the outermost exhaust pipes into the common pipe within the cylinder head.

16. The method of claim 14, wherein the part exhaust pipe merges with the outermost exhaust pipes into the common pipe at an outer wall of the cylinder head.

17. The method of claim 14, wherein the part exhaust pipe merges with the outermost exhaust pipes into the common pipe outside of the cylinder head such that three separate exhaust pipes emerge from the cylinder head before converging into the common pipe and the outermost exhaust pipes are isolated from the innermost exhaust pipes until they are outside of the cylinder head.

18. The method of claim 14, wherein exhaust from the common pipe is collected by a part segment of a turbine.

19. The method of claim 14, wherein the part exhaust pipe is separated from each of the outermost exhaust pipes by an outer wall segment upstream of the first junction.

* * * * *